US007441426B2

(12) United States Patent
Avganim

(10) Patent No.: US 7,441,426 B2
(45) Date of Patent: Oct. 28, 2008

(54) ARRANGEMENT FOR ARRESTING A PORTABLE OBJECT TO A STATIONARY OBJECT BY A CABLE

(76) Inventor: Mair Avganim, 156 Moshav Gealiya, M.P. Nachel Sorek 76885 (IL)

( * ) Notice: Subject to any disclaimer, the term of this patent is extended or adjusted under 35 U.S.C. 154(b) by 245 days.

(21) Appl. No.: 10/544,092

(22) PCT Filed: Jan. 22, 2004

(86) PCT No.: PCT/IL2004/000059

§ 371 (c)(1),
(2), (4) Date: Jul. 28, 2005

(87) PCT Pub. No.: WO2004/067887

PCT Pub. Date: Aug. 12, 2004

(65) Prior Publication Data

US 2006/0225470 A1 Oct. 12, 2006

(30) Foreign Application Priority Data

Jan. 30, 2003 (IL) ..... 154194

(51) Int. Cl.
*E05B 69/00* (2006.01)

(52) U.S. Cl. ..... 70/58; 70/14; 70/30; 70/49

(58) Field of Classification Search ..... 70/14, 70/18, 58, 30, 49

See application file for complete search history.

(56) References Cited

U.S. PATENT DOCUMENTS 3,859,826 A * 1/1975 Singer et al. ..... 70/58
4,305,266 A * 12/1981 Lockwood ..... 70/58
4,328,687 A * 5/1982 Ritchie ..... 70/34
4,893,777 A 1/1990 Gassaway
4,973,023 A 11/1990 O'Neill
5,127,244 A * 7/1992 Myers ..... 70/2
5,327,752 A 7/1994 Myers et al.
5,345,794 A * 9/1994 Jenks ..... 70/14
5,400,629 A * 3/1995 Myers ..... 70/491
5,709,110 A * 1/1998 Greenfield et al. ..... 70/58
5,875,657 A * 3/1999 Kelley ..... 70/18
5,913,907 A * 6/1999 Lee ..... 70/58

(Continued)

FOREIGN PATENT DOCUMENTS

EP 0839978 10/1997

*Primary Examiner*—Suzanne D Barrett
(74) *Attorney, Agent, or Firm*—Blakely, Sokoloff, Taylor & Zafman LLP

(57) ABSTRACT

An arrangement for arresting a portable object, such as a desk computer, to a stationary object using a cable (40), one end of which is looped around the stationary object. The other end of the cable (40) is secured to a block-like cable-shoe body (44). An oblong circular cavity (46) is formed in the body (44) with an undercut portion (48) extending along about 180 degrees of one side thereof. Further provided is a lock member (10) having a ribbed attachment portion (24). The attachment portion (24) comprises a recess (26) defined between first and second ribs (28; 30) and is adapted to be inserted into the cavity (46) and shifted into engagement with the undercut portion (48), and then locked thereinside by push-in key operated device (50). Said lock member (10), with ribbed attachment portion (24) is affixed to a side wall of the portable object in various conventional manners.

5 Claims, 5 Drawing Sheets

U.S. PATENT DOCUMENTS 6,205,824 B1 * 3/2001 Miao ..... 70/58
6,227,017 B1 * 5/2001 Igelmund ..... 70/58
6,244,082 B1 6/2001 Avganim
6,257,029 B1 * 7/2001 Liao ..... 70/58
6,317,936 B1 11/2001 McDaid et al.
6,360,405 B1 3/2002 McDaid et al.
6,401,502 B1 * 6/2002 Yang ..... 70/30
6,449,992 B1 * 9/2002 Yu et al. ..... 70/58
6,463,770 B1 * 10/2002 Lee ..... 70/58
6,536,244 B1 * 3/2003 Chang ..... 70/58
6,619,081 B1 * 9/2003 Yu ..... 70/58
6,622,532 B2 * 9/2003 Hsu ..... 70/14
6,705,133 B1 * 3/2004 Avganim ..... 70/14
6,708,535 B1 * 3/2004 Sanders ..... 70/58
6,758,069 B2 * 7/2004 Derman ..... 70/58
6,763,688 B1 * 7/2004 Syu ..... 70/14
6,880,373 B2 * 4/2005 Ling ..... 70/58
6,886,376 B2 * 5/2005 Kuo ..... 70/58
6,918,272 B1 * 7/2005 Sanders ..... 70/58
6,968,716 B1 * 11/2005 Ling ..... 70/14
6,971,254 B2 * 12/2005 Bellow et al. ..... 70/14
7,028,513 B2 * 4/2006 Avganim ..... 70/18
7,073,358 B1 * 7/2006 Lee ..... 70/58
7,100,403 B2 * 9/2006 Murray et al. ..... 70/58
7,143,614 B1 * 12/2006 Murray et al. ..... 70/58
7,150,168 B1 * 12/2006 Kuo ..... 70/491
7,249,474 B2 * 7/2007 Avganim ..... 70/14
2004/0065126 A1 * 4/2004 Yang ..... 70/58
2004/0129037 A1 * 7/2004 Avganim ..... 70/14
2004/0168486 A1 * 9/2004 Ling ..... 70/58
2005/0022566 A1 * 2/2005 Bellow et al. ..... 70/58
2005/0178172 A1 * 8/2005 Mc Gettrick ..... 70/58
2005/0204786 A1 * 9/2005 Meyer et al. ..... 70/58
2005/0223756 A1 * 10/2005 Ling et al. ..... 70/30
2006/0086160 A1 * 4/2006 Marszalek et al. ..... 70/58
2007/0119219 A1 * 5/2007 DeMartinis et al. ..... 70/58
2007/0169523 A1 * 7/2007 Lu ..... 70/58

* cited by examiner

ARRANGEMENT FOR ARRESTING A PORTABLE OBJECT TO A STATIONARY OBJECT BY A CABLE

FIELD OF THE INVENTION

The present invention generally relates to security devices. More specifically the invention concerns the safeguarding of desk computers against theft by tying the computer casing by a steel cable to a fixed object, say around the nearest desk leg.

BACKGROUND OF THE INVENTION

Using a steel cable as computer anti-theft means, in particular with regard to portable computers, is not new: see, e.g. U.S. Pat. Nos. 5,327,752 and 6,244,082. The innovative efforts were mostly directed as how to connect the cable to the computer casing without introducing major changes. As reflected by the above-mentioned patents, the solution found was to make use of a slot-shaped opening formed OEM at one of the casing walls. For less expensive, sheet metal desk computers, the problem has not yet been satisfactorily solved.

It is therefore the prime object of the invention to harness the sheet metal desk computer casing to a cable via means already existing in the conventional construction of such computers.

It is a further object of the invention to convert the conventional door lock of certain brand computers (IBM and others) into a universal attachment for a specially designed cable shoe.

It is a still further object of the invention to provide a "universal" attachment and fitting cable-shoe, forming together useful and convenient means for arresting any portable object, by the cable to a stationary object.

SUMMERY OF THE INVENTION

Thus provided according to the invention is an arrangement for arresting a portable object such as a desk computer against a stationary object by looping around the stationary object one end of a cable, the other end thereof being provided with a key-operated locking device, the arrangement comprises: a block-like cable-shoe body; an oblong circular cavity formed in the body with an undercut portion extending along about 180° of one side thereof; a ribbed attachment member, adapted to be inserted into the cavity and shifted into engagement with the undercut portion, and then locked thereinside by the key-operated device; and the portable object being provided with said ribbed attachment member affixed to a side wall thereof.

The cable-shoe and ribbed attachment member may be used for a variety of applications, such as in combination with hook locks, padlock ears, tongs locks, or as "stand-alone" devices.

BRIEF DESCRIPTION OF THE DRAWINGS

These and other constructional features and advantages of the invention will be more clearly understood in light of the ensuing description of a preferred embodiment thereof, given by way of example only, with reference to the accompanying drawings, wherein:—

DETAILED DESCRIPTION OF THE PREFERRED EMBODIMENT

Certain models of desk computer casings made of sheet metal with a hinged rear- or side-walls, are equipped with a most simple cylinder lock (often called "mail-box" locks). The following described embodiment of the invention is based on a substitute of this conventional, almost primitive and easily tampered with, lock by a locking device of an improved design.

Figure 1:
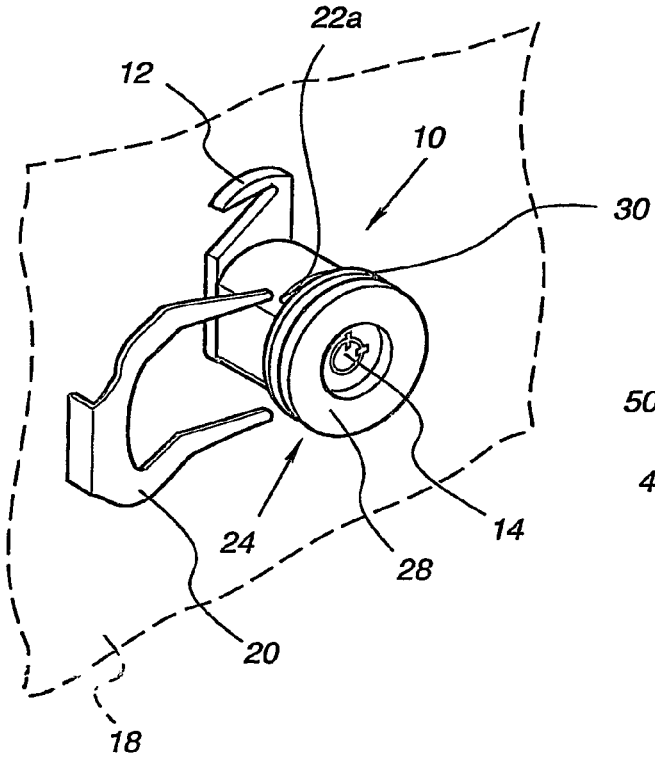
FIG. 1 is a general, perspective view of a computer door locking device modified according to a preferred embodiment of the invention.
Figure 3:
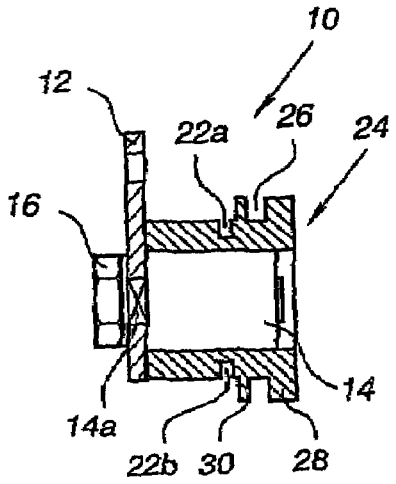
FIG. 3 is a cross-sectional view of the door lock of FIG. 1.
Figure 4:
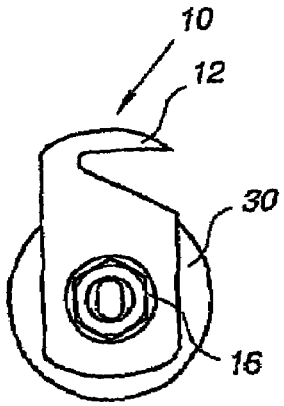
FIG. 4 is a rear view of the lock of FIG. 3.
Figure 5:
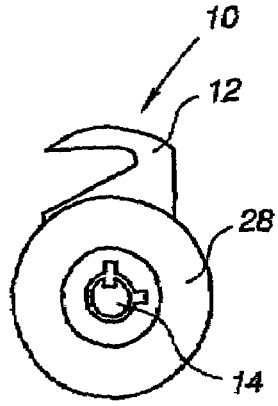
FIG. 5 is a front view of the lock of FIG. 3.

Hence, in FIG. 1 there is shown lock 10 which comprises a rotatably mounted hook member 12. The rotation of the hook member is effected by a push-in type lock 14 (see FIG. 3). The operator square pin 14*a* of the lock 14 is passed through the hook member 12 and fastened by nut 16.

The lock 10 is mounted to wall 18 of the computer in the conventional manner, namely by using a springy, bifurcated clip 20 adapted to fit into a pair of slits 22*a* and 22*b*. The major, unique part of the lock 10 consists of a "universal" attachment portion generally denoted 24. This is the core of the present invention and common to all applications and embodiments; it may even be applied as a "stand-alone" article (see FIG. 14).

The attachment portion 24 comprises a circular (in this example) recess 26, defined between first and second shoulders or ribs 28 and 30 of equal diameters. The roll of this double-rib structure will be readily understood in view of the description below.

Figure 2:
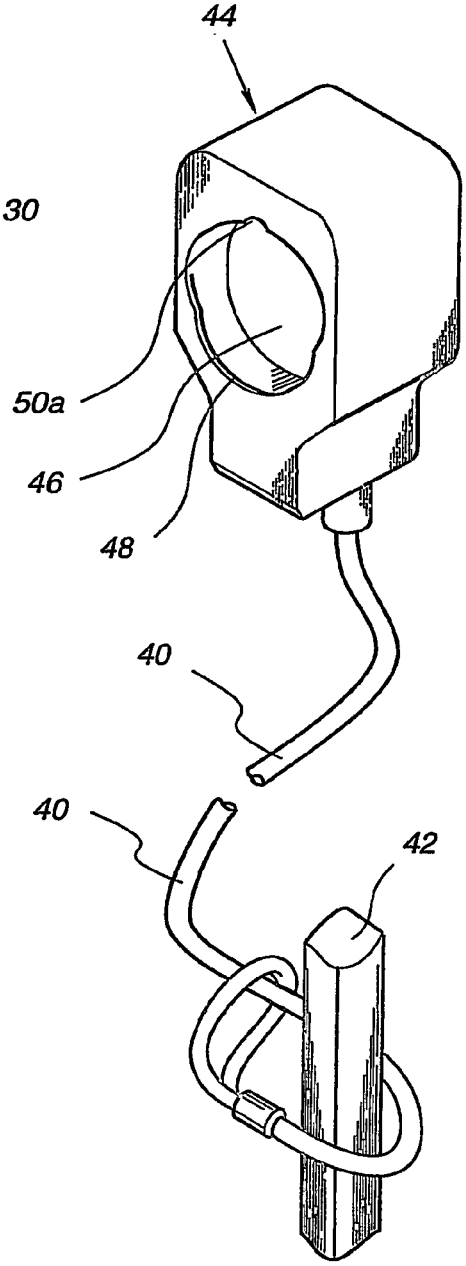
FIG. 2 is a perspective view of a cable with cable-shoe provided according to a preferred embodiment of the invention.
Figure 6:
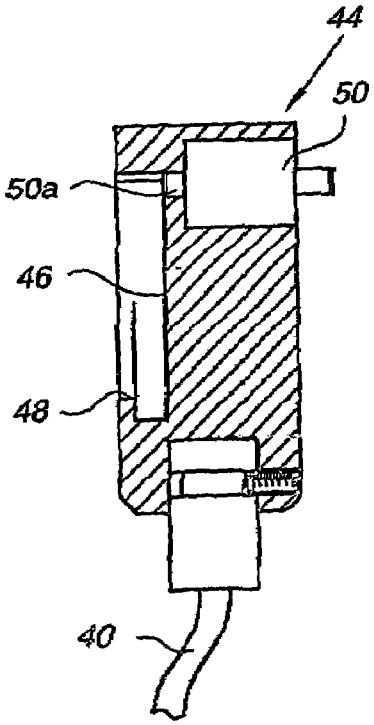
FIG. 6 is a cross-sectional view of the cable-shoe of FIG. 2.
Figure 7:
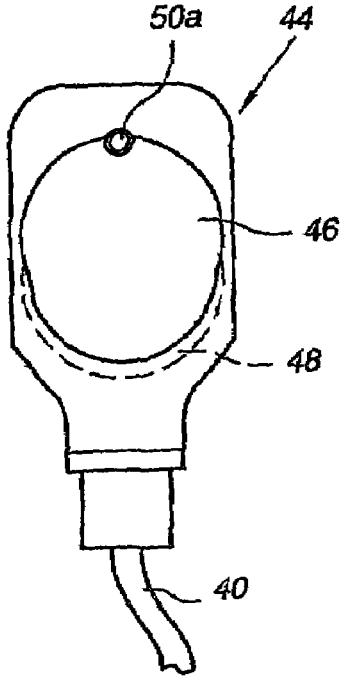
FIG. 7 is a front view of the cable-shoe of FIG. 6.
Figure 8:
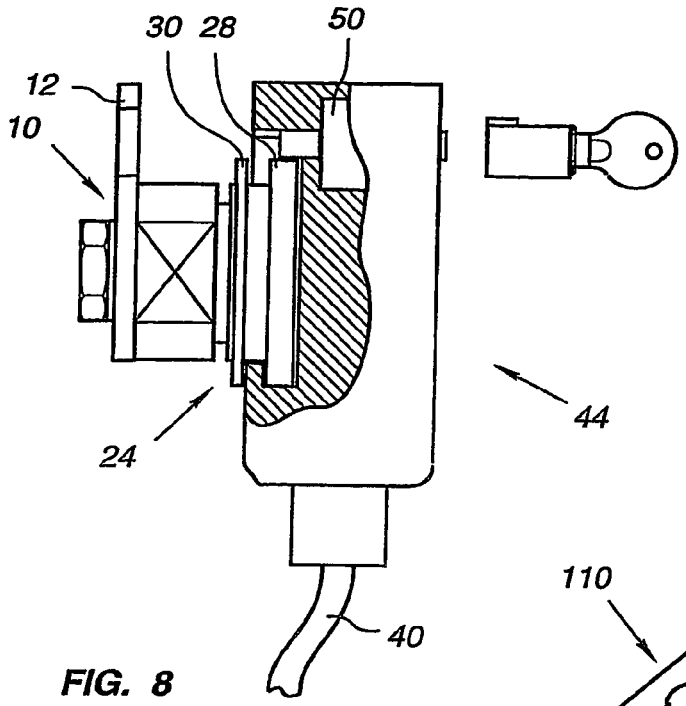
FIG. 8 shows in partial cross-section the door lock and the cable-shoe in the mating, locked position.

Turning to FIGS. 2, 6 and 7, there are shown steel cable 40 looped around an immovable object such as table leg 42. The other side of the cable 40 is connected to a cable-shoe generally denoted 44, and is preferably freely rotatable thereinside. The cable-shoe is generally block-shaped. At its front side, an elongated circular cavity 46 is formed, delimited at its lower side by gradually increasing lip 48, of the same diameter (or actually radius) as that of the circular rib 28. Due to this configuration it is made possible to insert the rib 28 of the lock 10 (FIG. 1) head-on into the upper part of the cavity 46, and then, by a short lifting movement of the cable-shoe, bringing it into engagement with the lip 48, embracing the rib 28 along about 180°—see FIG. 8. A push-in type lock 50 is seated in the cable-shoe body 44 so that its projectable lock pin 50*a*, when actuated, obstructs the upwards movement of the rib 28 and hence the disengagement of the computer lock 10 from the cable-shoe 44.

It will be readily understood that, with regard to this embodiment, two goals are achieved: the primitive conventional cylinder lock is replaced by a more sturdy and safe one, at no significant extra cost; and the cable-shoe is freely rotatable by 360° which enhances the convenience of its use due to the inflexible nature of the cable. This, however, will not be the case if the circular ribs 28 and 30—and consequently also the outline of the cavity 46—be made non-circular (e.g. elliptical or squarish).

Figure 9:
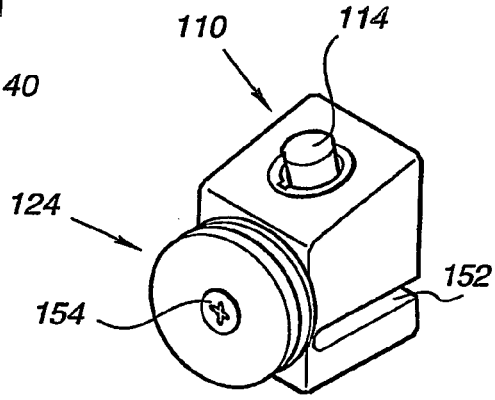
FIG. 9 is another example of a computer lock.
Figure 10:
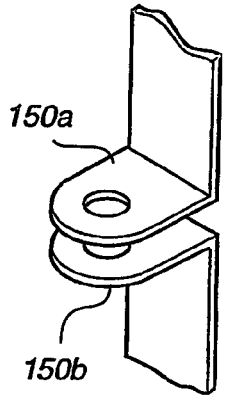
FIG. 10 partly shows a pair of padlock lockable ears in certain models of desk computers for locking the casing thereof.

The locking device 110 of FIG. 9 is designed to lock computers (or any other article such as toolboxes) by a padlock inserted through a pair of ears 150*a* and 150*b* as schematically depicted in FIG. 10.

Figure 11:
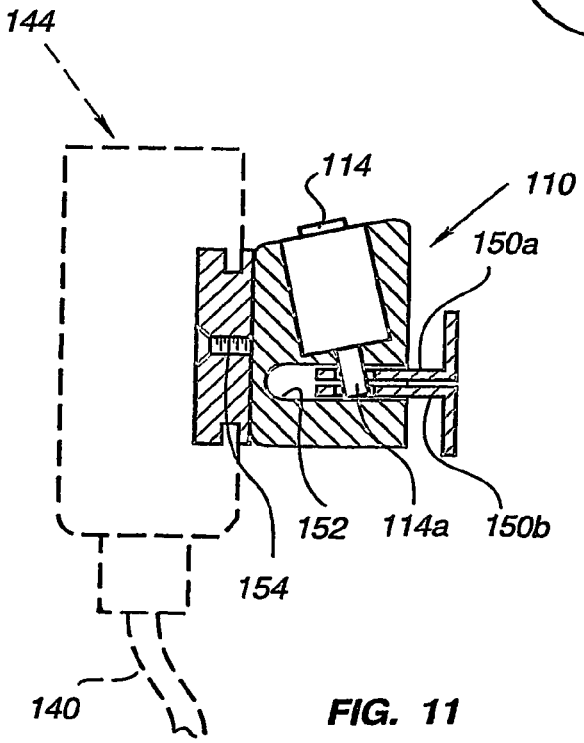
FIG. 11 shows the locking position of the lock of FIG. 9 against the ears of FIG. 10.

The lock 110 is generally a block-shaped body with a push-in locking device 114 implanted so that the operator pin 114*a* thereof is adapted to project into a slot 152 configured to receive the ears 150*a*, 150*b* (FIG. 11).

To the back of the lock body 114 there is fastened, e.g. by bolt 154, (or made integral therewith) the universal attachment member 124 of the design already familiar from the previous embodiment.

The cable-shoe 144 is shown in phantom lines in FIG. 11, by which the lock body 110 is arrested by cable 140 to a stationary object (not shown). To this end, the ears 150*a* and 150*b* are inserted into the slot 152 and the push-in lock 114 is operated so that its operator pin 114*a* becomes inserted into the padlock openings.

Figure 12:
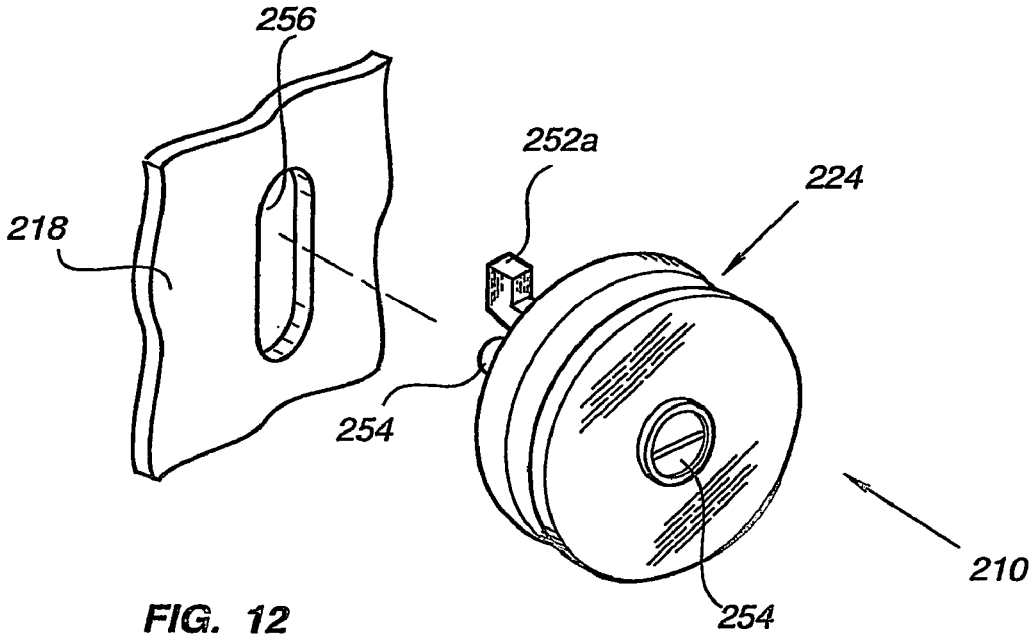
FIG. 12 is still another embodiment of a computer security lock.
Figure 13:
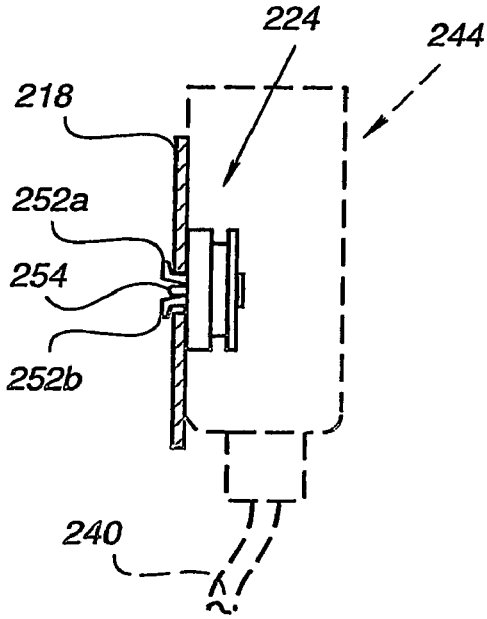
FIG. 13 illustrates the cable-shoe of the previous embodiments in an arresting position applied to the lock of FIG. 12.

In the embodiment illustrated in FIGS. 12 and 13 use is made of a known per-se device which is provided with a pair of pivotable tongs 252*a* and 252*b* adapted to become spaced-apart by rotating a screw-threaded pin 254. The tongs are insertable into a dedicated slot 256 formed in the portable computer wall 218 (as known in the art) and are then spread for locking. Now, according to this embodiment of the invention, the body carrying the tongs mechanism is shaped as a universal attachment member 224, namely fit to be engaged by cable-shoe 224 as in the previous embodiments.

Figure 14:
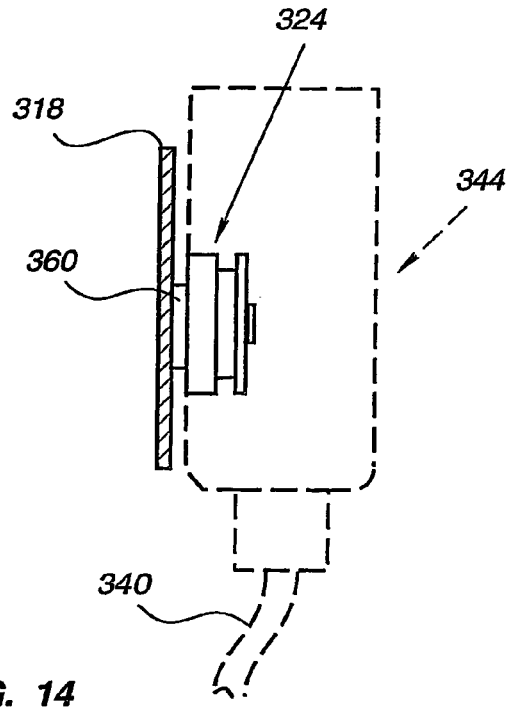
FIG. 14 illustrates the use of an attachment member and cable-shoe applied to any kind of wall surface.

FIG. 14 represents a most simple implementation of the invention. The universal attachment member 324 is in this case mounted to wall 318 by gluing, e.g. using a double-sided, peal-off paste patch 360.

Figure 15:
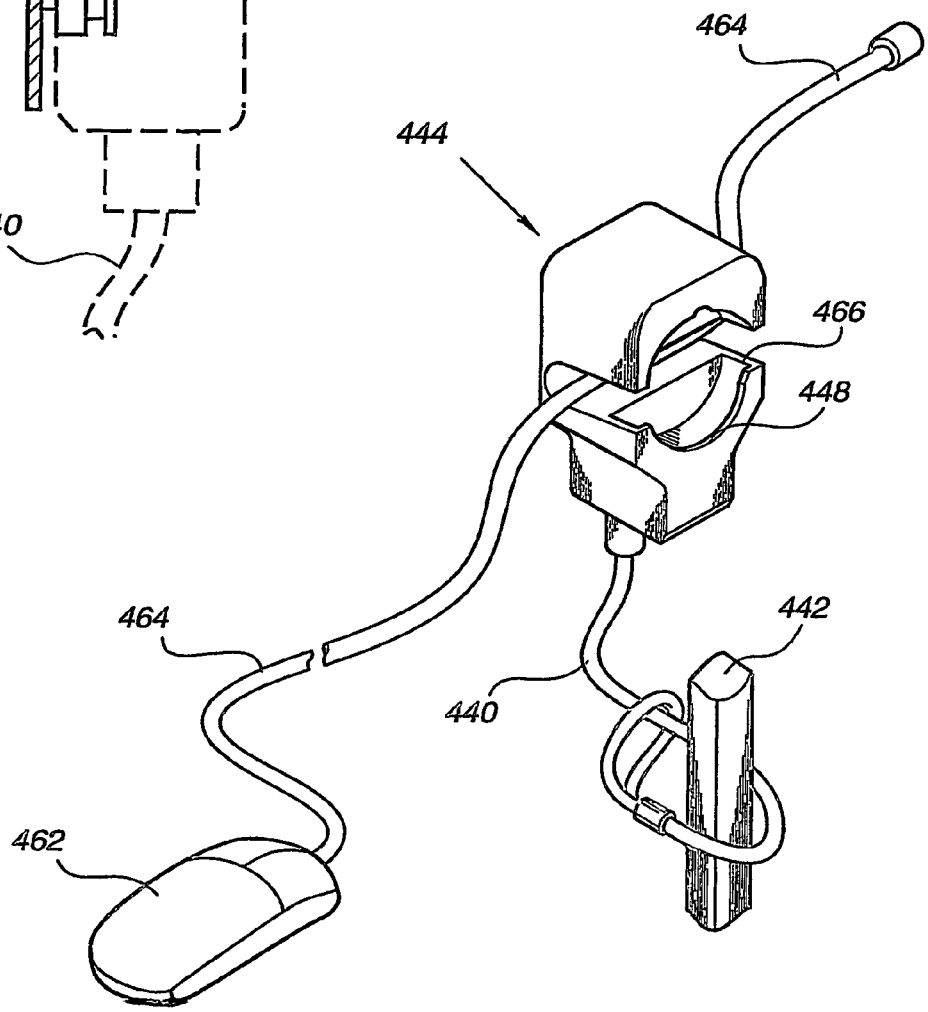
FIG. 15 shows how the cable shoe is used for safeguarding, in addition, other equipment such as a "mouse" or keyboard.

FIG. 15 illustrates the cable-shoe 444, modified in the sense that it is useful to entrap and secure, say, "mouse" 462, besides and simultaneously with arresting the computer proper. This is simply attained by providing a slot 466 into which cable 464 of the mouse 462 is placed before detaching the cable-shoe 444 to the side wall of the computer.

In summery, the arrangement proposed according to the invention offers a simple and low-cost solution to the ever-increasing stealing problem of computers or other valuable portable objects.

Those skilled in the art to which this invention pertains will readily appreciate that numerous changes, variations and modifications can be effected without departing from the true spirit and scope of the invention as defined in and by the appended claims.

What is claimed is:

1. An arrangement for arresting a portable object against a stationary object by looping around the stationary object one end of a cable and releasably coupling the other end thereof to the portable object, the arrangement comprising:

a block-shaped body to which said other end of the cable is affixed, the body having a planar side surface;

an oblong circular cavity formed in the planar side surface with an undercut portion extending along about 180° of one side thereof;

an attachment member comprising a flanging circular rib configured to fit into said cavity, said rib being of a width less than said undercut portion so that after fitting the attachment member into the cavity the attachment member is shiftable into engagement with the undercut portion thereby preventing a head-on releasing thereof from the cavity;

said body being further provided with a key operated locking device having a locking pin projectable into the cavity to restrain the shifting of the attachment member from a first shifted position thereof; and means for affixing the attachment member to a side wall of the portable object.

2. The arrangement as claimed in claim 1 wherein the key-operated device is of the push-in type.

3. The arrangement as claimed in claim 1 wherein the ribbed member forms the outer part of a rotatable hook-type computer door locking device.

4. The arrangement as claimed in claim 3 wherein the hook-type locking device is operable by a push-in locking device.

5. The arrangement as claimed in claim 1 wherein the cable-shoe body is formed with a slot traversing said cavity for enabling a cable of additional equipment to pass therethrough and become secured to the portable object upon locking the cable-shoe thereagainst.

* * * * *